US009140095B2

(12) United States Patent
Northam et al.

(10) Patent No.: US 9,140,095 B2
(45) Date of Patent: Sep. 22, 2015

(54) PACKER CUP FOR SEALING IN MULTIPLE WELLBORE SIZES ECCENTRICALLY

(71) Applicant: Weatherford/Lamb, Inc., Houston, TX (US)

(72) Inventors: Paul Northam, Houston, TX (US); Mark C. Glaser, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 14/052,505

(22) Filed: Oct. 11, 2013

(65) Prior Publication Data

US 2014/0102727 A1 Apr. 17, 2014

Related U.S. Application Data

(60) Provisional application No. 61/712,859, filed on Oct. 12, 2012.

(51) Int. Cl.
*E21B 33/126* (2006.01)
*E21B 33/12* (2006.01)

(52) U.S. Cl.
CPC ..... *E21B 33/1208* (2013.01); *E21B 33/126* (2013.01)

(58) Field of Classification Search
CPC ..... E21B 33/126; E21B 33/1208
USPC ..... 166/202; 277/335
See application file for complete search history.

(56) References Cited

U.S. PATENT DOCUMENTS 49,783 A * 9/1865 Parham ..... 277/335
2,852,323 A * 9/1958 Bowerman ..... 277/335
3,179,022 A * 4/1965 Bloudoff ..... 92/252
3,385,367 A 5/1968 Kollsman
3,422,902 A * 1/1969 Bouchillon ..... 166/202
3,605,886 A 9/1971 Cox et al.
3,670,815 A 6/1972 Brown
3,766,981 A 10/1973 Rundt
3,785,193 A 1/1974 Kinley et al.
4,423,754 A * 1/1984 Carter, Jr. ..... 138/93
4,441,721 A 4/1984 Harris et al.
4,528,896 A * 7/1985 Edwards ..... 92/242
4,751,870 A * 6/1988 Gramling ..... 92/209
5,078,211 A 1/1992 Swineford (Continued)

FOREIGN PATENT DOCUMENTS

WO WO 2011020987 A2 * 2/2011

OTHER PUBLICATIONS

Extended European Search Report, dated Aug. 7, 2014.

*Primary Examiner* — Giovanna C Wright
(74) *Attorney, Agent, or Firm* — Patterson & Sheridan, L.L.P.

(57) ABSTRACT

The present invention generally relates to a packer for creating a seal in an annular area. In one aspect, a packer cup for use in a wellbore is provided. The packer cup includes a base and a first seal segment having a first end and a second end. The first end of the first seal segment is attached to the base. The packer cup further includes a second seal segment that is spaced apart from the base. The second seal segment is attached to the second end of the first seal segment, wherein each seal segment is configured to move from a retracted shape to an expanded shape upon activation of the respective seal segment. In another aspect, a method for creating a seal between a tubular and a wellbore is provided. In a further aspect, a packer is provided.

20 Claims, 10 Drawing Sheets

(56) References Cited

U.S. PATENT DOCUMENTS

| | | | | |
|---|---|---|---|---|
| 5,791,416 | A * | 8/1998 | White et al. | 166/285 |
| 6,142,227 | A | 11/2000 | Hiorth et al. | |
| 6,182,755 | B1 * | 2/2001 | Mansure | 166/180 |
| 6,443,458 | B1 | 9/2002 | Jansch | |
| 6,827,150 | B2 | 12/2004 | Luke | |
| 7,261,153 | B2 * | 8/2007 | Plomp | 166/202 |
| 7,328,742 | B2 | 2/2008 | Slack | |
| 7,357,177 | B2 * | 4/2008 | Garwood et al. | 166/202 |
| 2010/0139929 | A1 | 6/2010 | Rytlewski et al. | |
| 2010/0307771 | A1 | 12/2010 | McRobb et al. | |
| 2011/0037229 | A1 | 2/2011 | Clarke | |
| 2012/0067588 | A1 | 3/2012 | Awid et al. | |
| 2014/0318812 | A1 | 10/2014 | Moyes | |

* cited by examiner

PACKER CUP FOR SEALING IN MULTIPLE WELLBORE SIZES ECCENTRICALLY

CROSS-REFERENCE TO RELATED APPLICATIONS

This application claims benefit of U.S. provisional patent application Ser. No. 61/712,859, filed Oct. 12, 2012, which is herein incorporated by reference.

BACKGROUND OF THE INVENTION

1. Field of the Invention

Embodiments of the present invention generally relate to a wellbore operation. More particularly, embodiments of the present invention relate to a packer cup for sealing a wellbore.

2. Description of the Related Art

During a wellbore operation, it is necessary to isolate one portion of the wellbore from another a portion of the wellbore. The device that is used to isolate the wellbore portion is called a packer cup. The conventional packer cup includes a back-up ring attached to a rubber member. However, the conventional packer cup has a limited acceptable range for sealing applications inside an eccentric wellbore and an off-center packer cup application due to the design of the back-up ring and the rubber member. Therefore, there is a need for a packer cup for creating a seal in the eccentric wellbore and the off-center packer cup application.

SUMMARY OF THE INVENTION

The present invention generally relates to a packer for creating a seal in an annular area. In one aspect, a packer cup for use in a wellbore is provided. The packer cup includes a base and a first seal segment having a first end and a second end. The first end of the first seal segment is attached to the base. The packer cup further includes a second seal segment that is spaced apart from the base. The second seal segment is attached to the second end of the first seal segment, wherein each seal segment is configured to move from a retracted shape to an expanded shape upon activation of the respective seal segment.

In another aspect, a method for creating a seal between a tubular and a wellbore is provided. The method includes the step of positioning a packer cup in the wellbore. The packer cup has a first seal segment attached to a base and a second seal segment spaced apart from the base, and attached to the first seal segment. The method further includes the step of activating the seal segments, which causes each seal segment to move from a retracted shape to an expanded shape. Additionally, the method includes the step of creating the seal between the tubular and the wellbore as the seal segments engage the wellbore in the expanded shape.

In a further aspect, a packer is provided. The packer includes a base configured to be attached to a tubular. The packer further includes a first seal segment having a first end and a second end. The first end of the first seal segment is attached to the base. The packer also includes a second seal segment that is spaced apart from the base. The second seal segment is attached to the second end of the first seal segment. Additionally, the packer includes a third seal segment that is spaced apart from the base. The second seal segment is attached to an end of the second seal segment, wherein each seal segment has a different outer diameter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention, and are therefore not to be considered limiting of its scope, for the invention may admit to other equally effective embodiments.

DETAILED DESCRIPTION

The present invention generally relates to a packer cup for sealing a wellbore. The packer cup will be described herein in relation to pipe that is used in the wellbore. It is to be understood, however, that the packer cup may also be used with other downhole tools, such as a whipstock seal, or a debris barrier, without departing from principles of the present invention. Further, the packer cup may be used in a cased wellbore or within an open-hole wellbore. To better understand the novelty of the packer cup of the present invention and the methods of use thereof, reference is hereafter made to the accompanying drawings.

Figure 1:
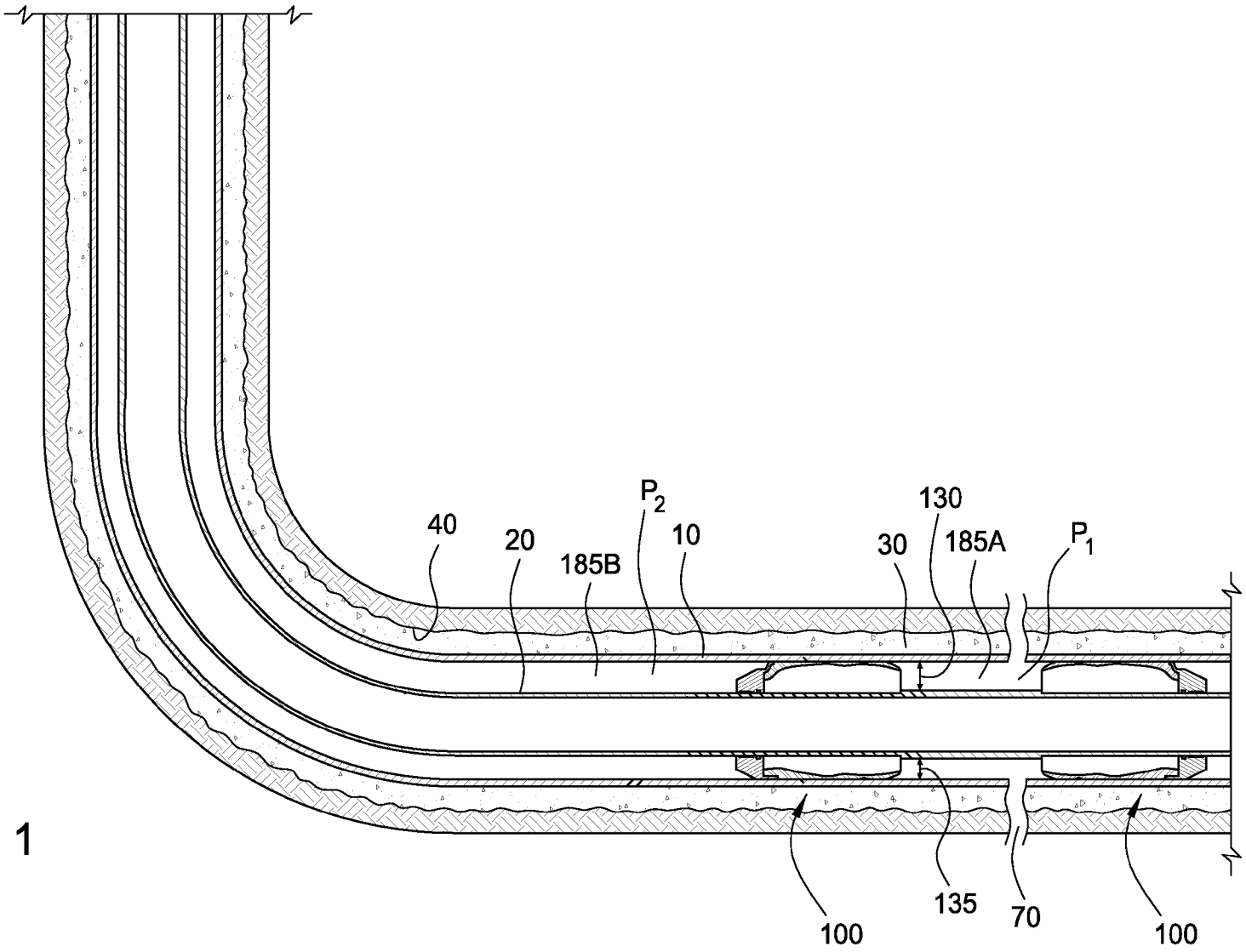
FIG. 1 is a view of a packer cup disposed in a wellbore.

FIG. 1 is a view of a packer cup 100 disposed in a wellbore 40. The packer cup 100 is used to isolate a defect 70 in the wellbore 40. The packer cup 100 is attached to a workstring 20. As shown in FIG. 1, a casing 10 is disposed in the wellbore 40. The casing 10 may be cemented in the wellbore 40 using cement 30 and may include multiple sections of casings coupled together to form the casing 10.

Located along the length of the casing 10 is the defect 70, such as a leaking connection or a fracture in the wall of the casing 10. The defect 70 may permit the loss of a fluid, such as a liquid or a gas, into the surrounding earthen formation or permit the introduction of unwanted fluids into the casing 10 of the wellbore 40. As a result, dangerous pressure fluctuations may occur during the formation or completion of the wellbore 40. To isolate the defect 70, one or more packer cups 100 are used. As shown in FIG. 1, two packer cups 100 are used to isolate a first portion 185A of the wellbore 40 from a second portion 185B of the wellbore 40. The first portion 185A has a pressure P1 that is greater than a pressure P2 in the second portion 185B of the wellbore 40. Generally, the opening of the packer cup 100 is facing the portion of the wellbore having the higher pressure (as shown). As will be described herein, the pressure (e.g., pressure P1) adjacent the packer cup 100 will be used to set the packer cup 100 in the wellbore 40.

As shown in FIG. 1, the workstring 20 is not centered in the casing 10. In other words, a longitudinal axis of the workstring 20 is offset from a longitudinal axis of the casing 10. As a result, distance 130 is greater than distance 135. Generally, a workstring in a horizontal wellbore may sag, which causes the packer cup 100 to be off-center in the casing 10. The conventional packer cup may not be able to create a seal with the casing when the conventional packer cup is off-center in the casing. However, the packer cup 100 of the present invention is configured to create a seal with the casing, even if the packer cup 100 is off-center, or if the packer cup 100 is placed within an eccentric casing (or wellbore).

Figure 2A:
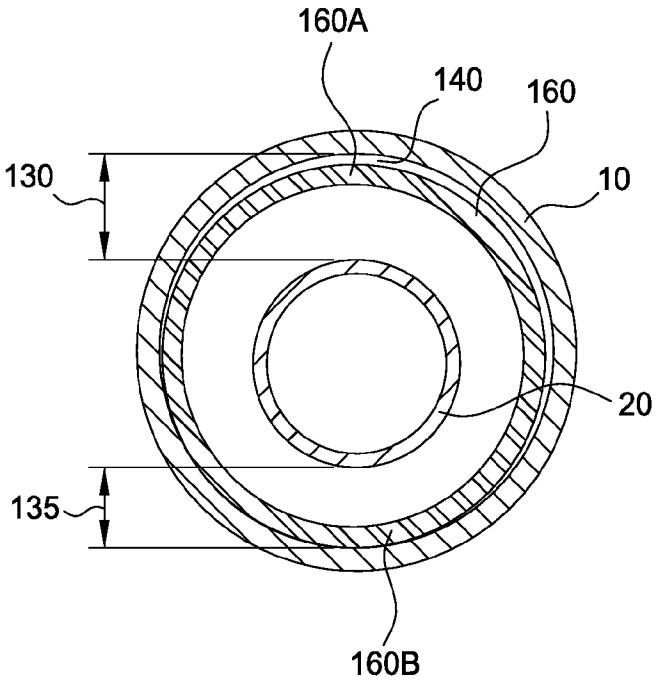
FIGS. 2 and 2A illustrate a view of the packer cup in a run-in position.
Figure 2:
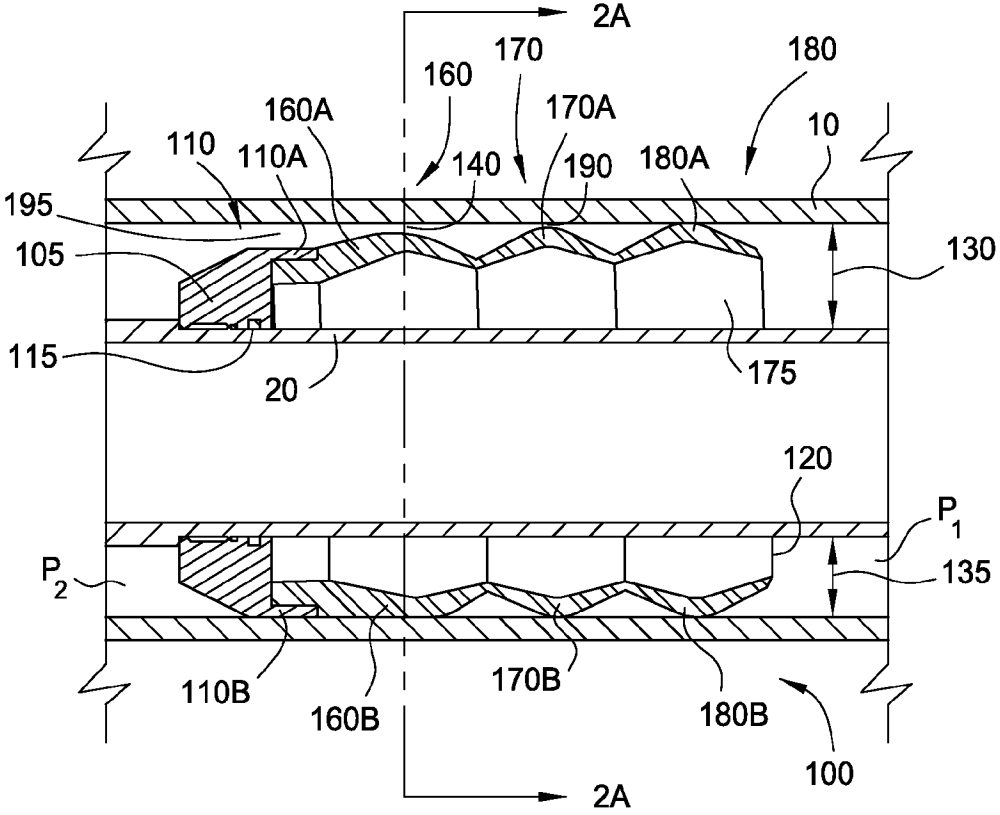

FIGS. 2 and 2A illustrate a view of the packer cup 100 in a run-in position. As shown, the packer cup 100 includes a base 105 with a lip 110 and seal segments 160, 170, 180. The seal segments 160, 170, 180 are interconnected together. In one embodiment, the seal segments 160, 170, 180 are separate pieces (and/or material) that are attached together by bonding, glue or another attachment method. In another embodiment, the seal segments 160, 170, 180 are formed from a single piece. In either case, the seal segments 160, 170, 180 are designed to engage and create a seal with the casing 10 upon activation of the packer cup 100. The packer cup 100 in FIG. 2 shows three seal segments, however, two or more seal segments may be used in the packer cup 100 without departing from principles of the present invention. The seal segments 160, 170, 180 are connected to the base 110. As shown, a portion of the seal segment 160 is disposed under the lip 110. The base 105 is configured to be attached to the workstring 20 by a connection member 115, such as threads, key and groove arrangement or any other type of connection member. A seal member (not shown) may be placed between the base 105 and the workstring 30 to create a seal therebetween. As also shown, an annulus 175 is defined between an outer surface of the workstring 20 and an inner surface of the seal segments 160, 170, 180.

The seal segments 160, 170, 180 are configured to seal an annulus between the workstring 20 and the casing 10. The seal segments 160, 170, 180 are configured to move between a retracted shape (FIG. 2) and an expanded shape (FIG. 4). Each seal segment 160, 170, 180 is an annular member that is made of a flexible material, such as elastomer or plastic. In the embodiment shown, each seal segment 160, 170, 180 has a different outer diameter (OD). The OD of seal segment 160<the OD of seal segment 170<the OD of seal segment 180. As shown, a gap 140 is formed between seal segment 160 and the casing 10, and a smaller gap 190 is formed between seal segment 170 and the casing 10. Additionally, a gap 195 is formed between the lip 110 and the casing 10.

The packer cup 100 is off-center in the casing 10. As shown in FIG. 2, the upper portions 160A, 170A of the seal segments 160, 170 are not in contact with the casing 10, while the lower portions 160B, 170B, 180B of the seal segments 160, 170, 180 are in contact with the casing 10. Additionally, the upper portion 110A of the lip 110 is not in contact with the casing 10, while the lower portion 1108 of the lip 110 is in contact with the casing 10.

FIG. 2A is a sectional view along line 2A-2A in FIG. 2. As shown, the gap 140 is formed between seal segment 160 and the casing 10, because the workstring 20 is offset relative to the casing 10 (distance 130>distance 135) and the OD of seal segment 160. As also shown, the thickness of the upper portion 160A of seal segment 160 and the lower portion 1608 of seal segment 160 have substantially the same thickness in the run-in position.

Figure 3A:
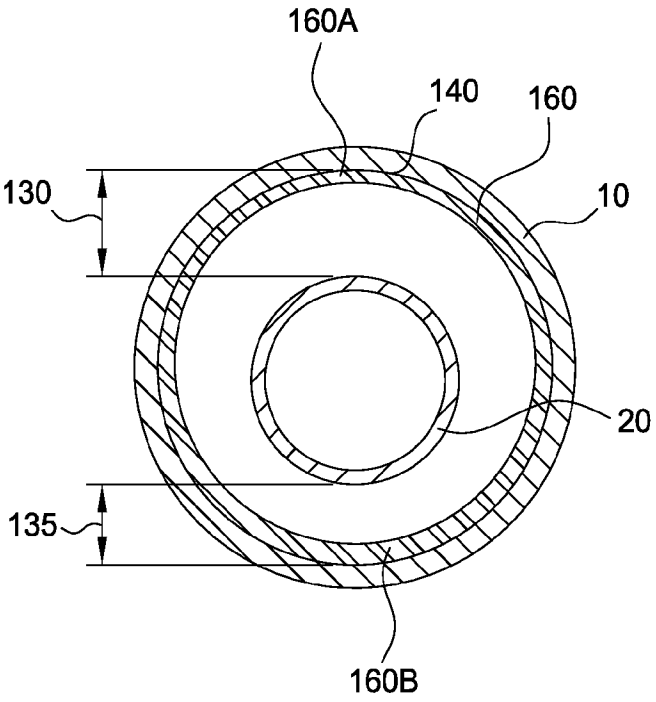
FIGS. 3 and 3A illustrate a view of the packer cup in an intermediate expanded position.
Figure 3:
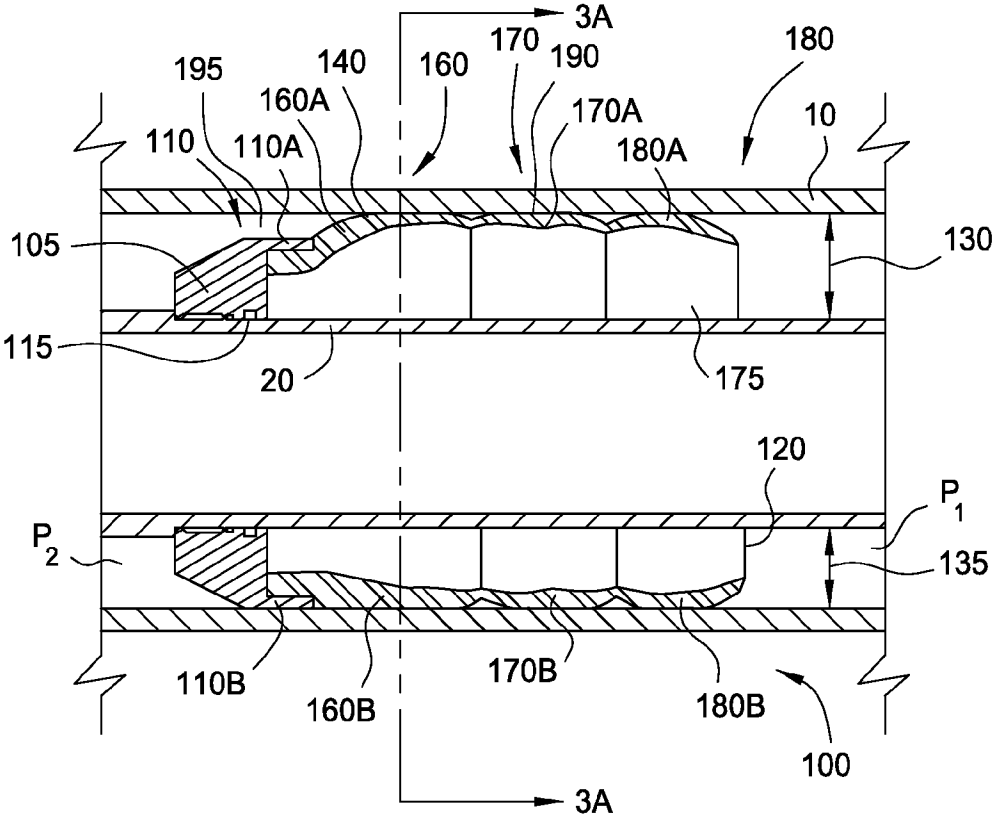

FIGS. 3 and 3A illustrate a view of the packer cup 100 in an intermediate expanded position. After the packer cup 100 is positioned within the casing 10, pressure P1 activates the packer cup 100 in order to isolate a portion of the wellbore. More specifically, the pressure P1 enters an opening 120 of the packer cup 100 and moves into the annulus 175, which causes the seal segments 160, 170, 180 to expand radially outward toward the casing 10. The seal segments 160, 170, 180 are made from a flexible material, and since pressure P1 is greater than P2, the seal segments 160, 170, 180 are urged radially outward. In comparing FIG. 3 (intermediate expanded position) and FIG. 2 (run-in position), it can be seen that the upper portions of the seal segments 160A, 170A, 180A are in contact with the casing 10, which results in the gaps 140 and 190 being substantially closed. It can also be seen that the lower portions of the seal segments 160B, 170B, 180B have more surface area in contact with the casing 10 in the intermediate expanded position. It can be further seen that the gap 195 between the upper lip 110A and the casing 10 is still present in the intermediate expanded position.

FIG. 3A is a sectional view along line 3A-3A in FIG. 3. As shown, the gap 140 formed between seal segment 160 and the casing 10 has been closed due to the activation of the packer cup 100. It is to be noted that the workstring 20 remains offset relative to the casing 10 (distance 130>distance 135).

Figure 4A:
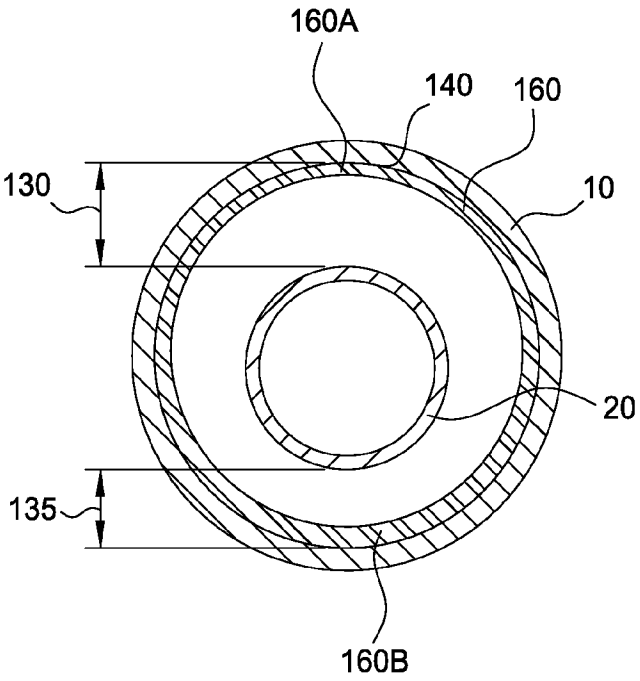
FIGS. 4 and 4A illustrate a view of the packer cup in an expanded position.
Figure 4:
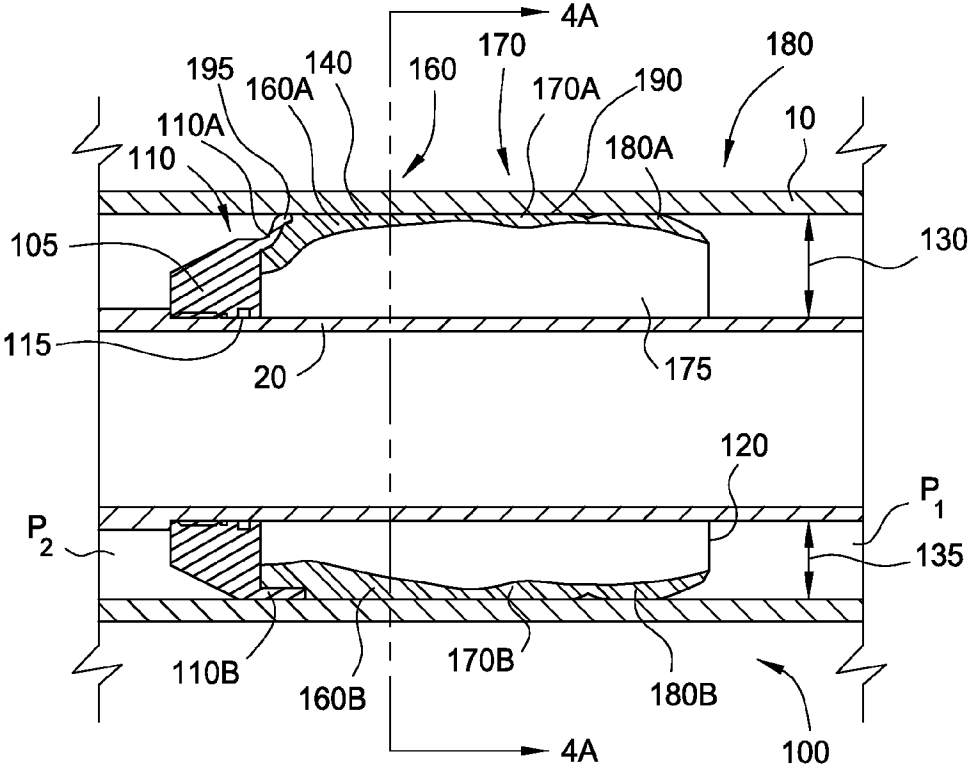

FIGS. 4 and 4A illustrate a view of the packer cup 100 in an expanded position. The packer cup 100 has been expanded by the pressure P1 in the annulus 175. In comparing FIG. 4 (expanded position) and FIG. 3 (intermediate expanded position), it can be seen that the upper portions of the seal segments 160A, 170A, 180A and the lower portions of the seal segments 160B, 170B, 180B have more surface area in contact with the casing 10. It can also be seen that the gap 195 between the upper lip 110A and the casing 10 has been closed, and the upper lip 110A and the lower lip 1108 are in contact with casing 10. In one embodiment, the lip 110 may act as a barrier to the flow of the material of the seal segments 160, 170, 180. In this manner, the lip 110 in the packer cup 100 may act as an anti-extrusion device or an extrusion barrier. In another embodiment, the lip 110 may act as an anchor portion that secures the packer cup 100 in the casing 10.

FIG. 4A is a sectional view along line 4A-4A in FIG. 4. As shown, the gap 140 formed between seal segment 160 and the casing 10 is closed due to the activation of the packer cup 100. As also shown, the thickness of the upper portion 160A of seal segment 160 is smaller than the thickness of the lower portion 160B of seal segment 160, because the upper portion 160A was radially expanded further relative to the centerline of the packer cup 100 than the lower portion 160B, due to the packer cup 100 being off-center in the casing 10. In this manner, the packer cup 100 is capable of sealing an annulus between the casing 10 and the string 20, even with the packer cup 100 being off-center in the casing 10.

Figure 5:
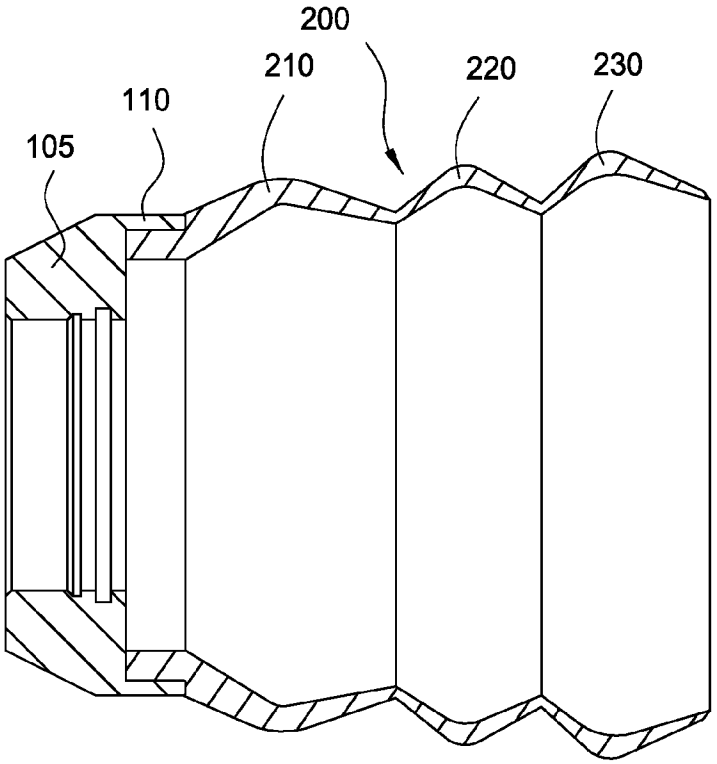
FIG. 5 illustrates a view of a packer cup.

FIG. 5 illustrates a view of a packer cup 200. For convenience, the components in the packer cup 200 that are similar to the components in the packer cup 100 will be labeled with the same number indicator. The packer cup 200 includes seal segments 210, 220, 230 and the base 105. The seal segments 210, 220, 230 are interconnected together. The seal segments 210, 220, 230 may be separate pieces (and/or material) that are attached together, or the seal segments 210, 220, 230 may be formed from a single piece. In either case, the seal segments 210, 220, 230 are designed to engage and create a seal with the casing (not shown) upon activation of the packer cup 200. Each seal segment 210, 220, 230 may have a different outer diameter (OD). For instance, the OD of seal segment 210 may be less than the OD of seal segment 220, which may be less than the OD of seal segment 230. Further, each seal segment 210, 220, 230 may have a different longitudinal length. For instance, the length of seal segment 220 may be shorter than the length of seal segment 230, which may be shorter than the length of seal segment 210. Additionally, the thickness of the seal segments 210, 220, 230 may be different. Each characteristic (e.g., diameter, length, thickness, number of seal segments) of the seal segment 210, 220, 230 may be selected based upon the application in the wellbore.

Figure 6:
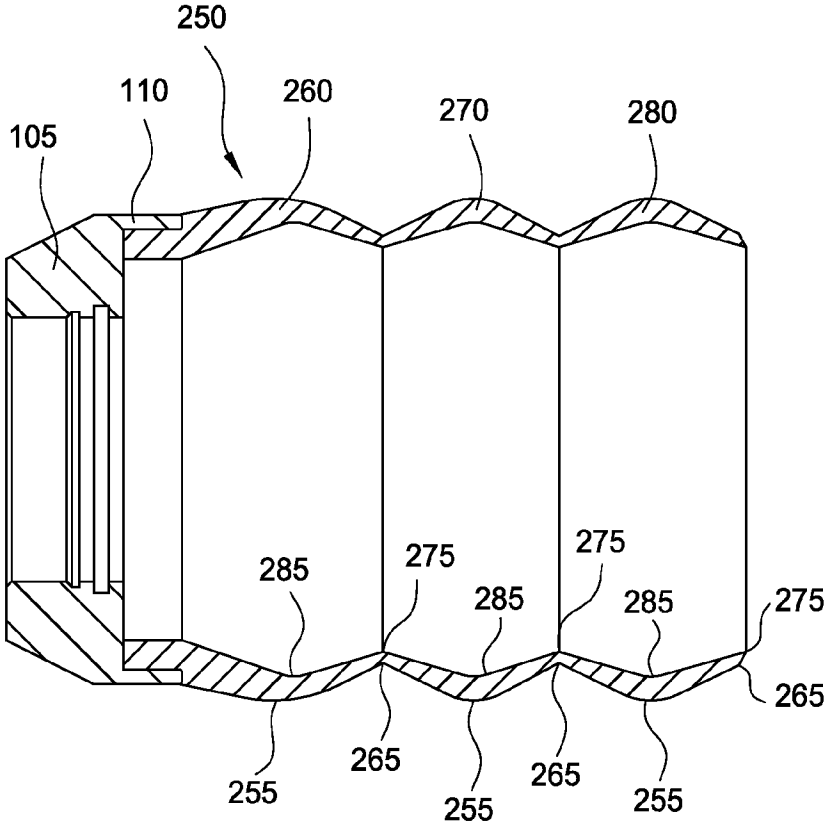
FIG. 6 illustrates a view of a packer cup.

FIG. 6 illustrates a view of a packer cup 250. For convenience, the components in the packer cup 250 that are similar to the components in the packer cup 100 will be labeled with the same number indicator. The packer cup 250 includes seal segments 260, 270, 280 and the base 105. The seal segments 260, 270, 280 are interconnected together. In one embodiment, the seal segments 260, 270, 280 may be made from different material, such as a rubber material having a different durometer. The seal segments 260, 270, 280 may be attached together to form a single unit of seal segments. In another embodiment, the seal segments 260, 270, 280 may be made from the same material and attached together or formed from a single piece. Similar to the other packer cups set forth herein, the seal segments 260, 270, 280 are designed to engage and create a seal with the casing (not shown) upon activation of the packer cup 250. In the embodiment shown in FIG. 6, each seal segment 260, 270, 280 has several different diameters. For example, each seal segment 260, 270, 280 has a first diameter 255, a second diameter 265, a third diameter 275, and a fourth diameter 285. The alternating large diameter sections and small diameter sections create a redundancy that allows the packer cup 250 to create a seal with the casing (or wellbore), even if the packer cup 250 is off-center, or if the packer cup 250 is placed within an eccentric casing (or wellbore). Further, each seal segment 260, 270, 280 may have the same or different longitudinal length. Additionally, each seal segment 260, 270, 280 may have the same or different thickness. Each characteristic (e.g., diameter, length, thickness, number of seal segments) of the seal segment 260, 270, 280 may be selected based upon the application in the wellbore.

Figure 7A:
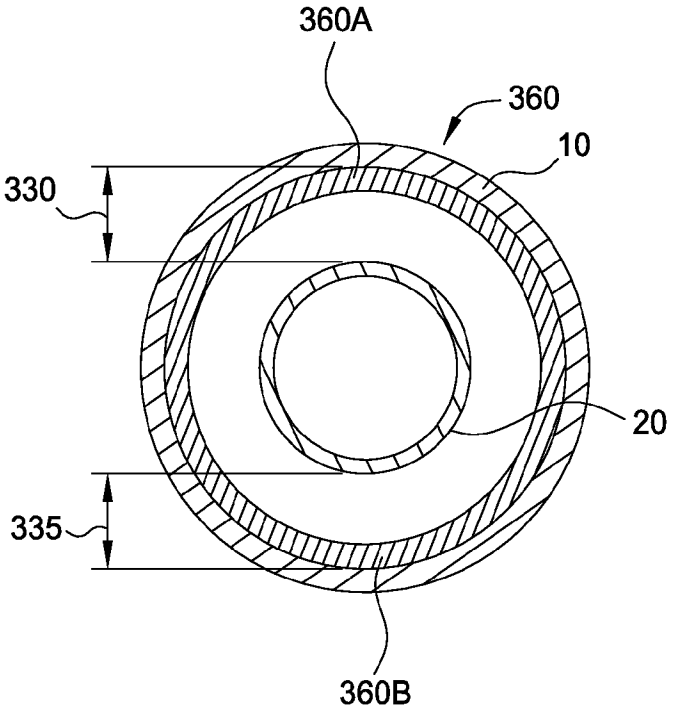
FIGS. 7 and 7A illustrate a view of the packer cup in a run-in position.
Figure 7:
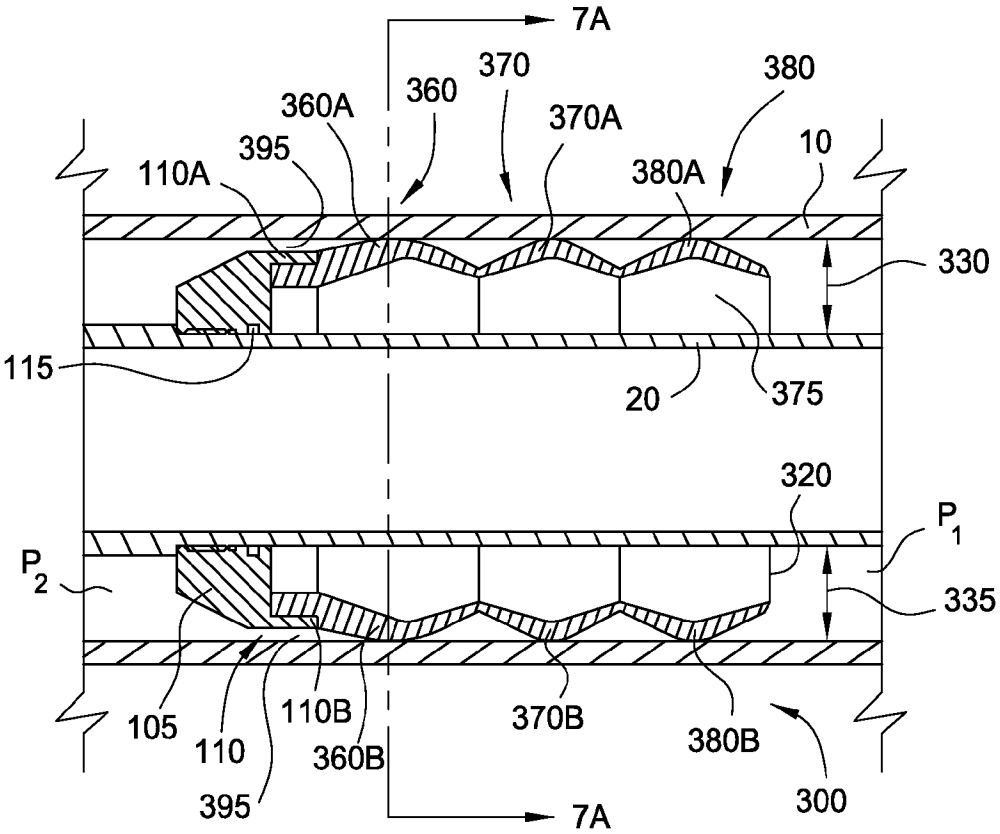

FIGS. 7 and 7A illustrate a view of the packer cup 300 in a run-in position. For convenience, the components in the packer cup 300 that are similar to the components in the packer cup 100 will be labeled with the same number indicator. As shown, the packer cup 300 includes seal segments 360, 370, 380, which are attached to the base 105. The seal segments 360, 370, 380 are interconnected together to form a single unit. In one embodiment, the seal segments 360, 370, 380 are separate pieces (and/or material) that are attached together by bonding, glue or another attachment method. In another embodiment, the seal segments 360, 370, 380 are formed from a single piece. The seal segments 360, 370, 380 are designed to engage and create a seal with the casing 10 upon activation of the packer cup 300. Even though the packer cup 300 is illustrated with three seal segments, the packer cup 300 may include two or more seal segments without departing from principles of the present invention. An annulus 375 is defined between an outer surface of the workstring 20 and an inner surface of the seal segments 360, 370, 380.

The seal segments 360, 370, 380 are configured to create a seal between the workstring 20 and the casing 10. The seal segments 360, 370, 380 are configured to move between a retracted shape (FIG. 7) and an expanded shape (FIG. 9). Each seal segment 360, 370, 380 is an annular member that is made of a flexible material, such that the seal segments 360, 370, 380 deform upon application of a pressure. In the embodiment shown, each seal segment 360, 370, 380 has substantially the same outer diameter (OD).

The packer cup 100 is substantially centered in the casing 10. In other words, distance 330 is substantially equal to distance 335. As shown FIG. 7, upper portions 360A, 370A, 380A of the seal segments 360, 370, 380 and the lower portions 360B, 370B, 380B of the seal segments 360, 370, 380 are in contact with the casing 10. Additionally, the upper portion 110A and lower portion 1108 of the lip 110 are not in contact with the casing 10.

FIG. 7A is a sectional view along line 7A-7A in FIG. 7. As shown, the entire section of seal segment 360 is engaged with the casing 10 because the workstring 20 is substantially centered in the casing 10 (distance 330 is substantially equal to distance 335) and the OD of seal segment 360. As also shown, the upper portion 360A of seal segment 360 and the lower portion 360B of seal segment 360 have substantially the same thickness in the run-in position.

Figure 8A:
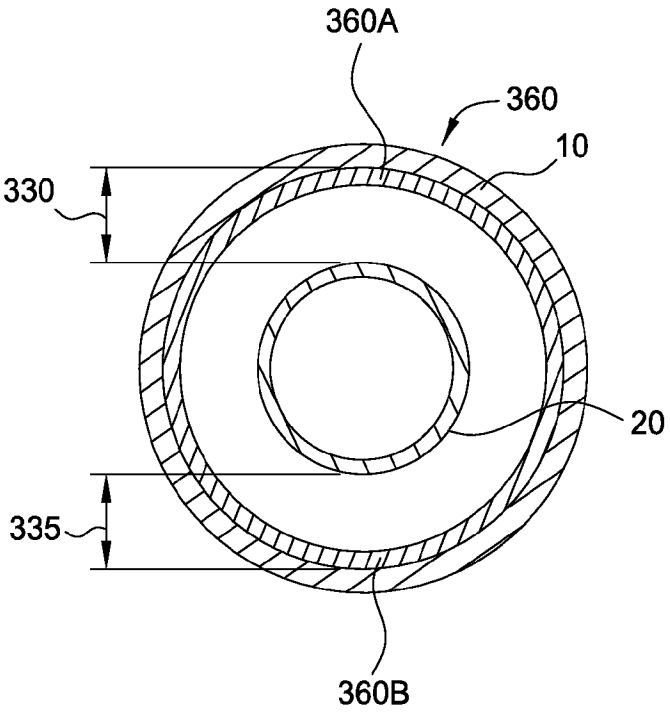
FIGS. 8 and 8A illustrate a view of the packer cup in an intermediate expanded position.
Figure 8:
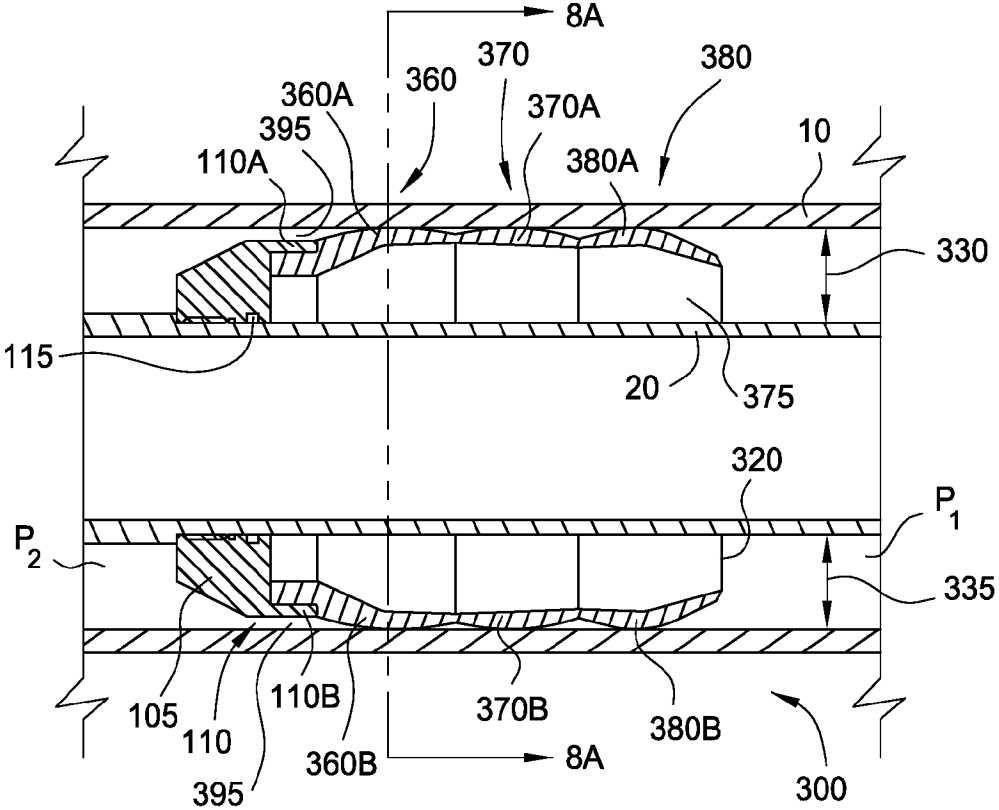

FIGS. 8 and 8A illustrate a view of the packer cup 300 in an intermediate expanded position. After the packer cup 300 is positioned within the casing 10, pressure P1 activates the packer cup 300 in order to isolate a portion of the wellbore. More specifically, the pressure P1 enters an opening 320 of the packer cup 330 and moves into the annulus 375, which causes the seal segments 360, 370, 380 to expand radially outward toward the casing 10. The seal segments 360, 370, 380 are made from a flexible material, and since pressure P1 is greater than pressure P2, the seal segments 360, 370, 380 are urged radially outward. In comparing FIG. 8 (intermediate expanded position) and FIG. 7 (run-in position), it can be seen that the upper portions 360A, 370A, 380A and the lower portions 360B, 370B, 380B of the seal segments have been expanded radially outward into further contact with the surrounding casing 10. It can be further seen that the gap 395 between the lips 110A, 1108 and the casing 10 is still present in the intermediate expanded position.

FIG. 8A is a sectional view along line 8A-8A in FIG. 8. As shown, the workstring 20 remains substantially centered relative to the casing 10 (distance 330 is substantially equal to distance 335). As also shown, the upper portion 360A of seal segment 360 and the lower portion 360B of seal segment 360 have substantially the same thickness in the intermediate expanded position.

Figure 9A:
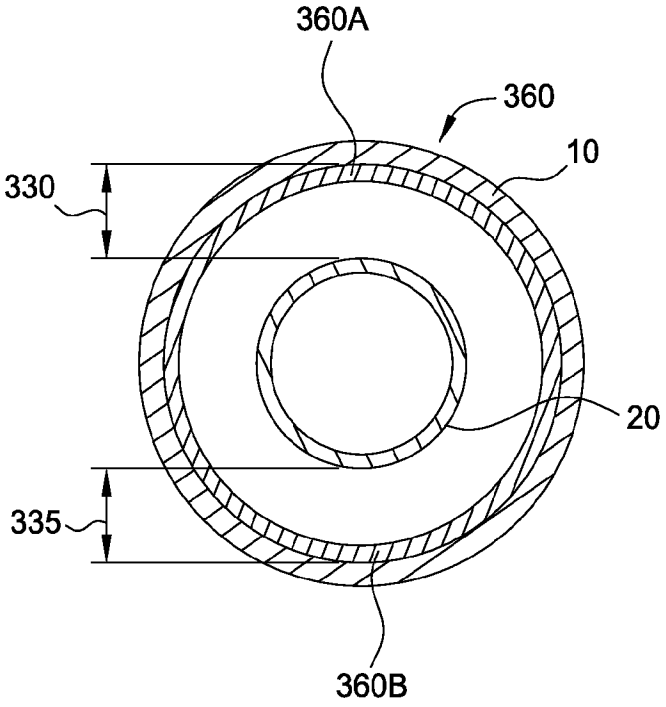
FIGS. 9 and 9A illustrate a view of the packer cup in an expanded position.
Figure 9:
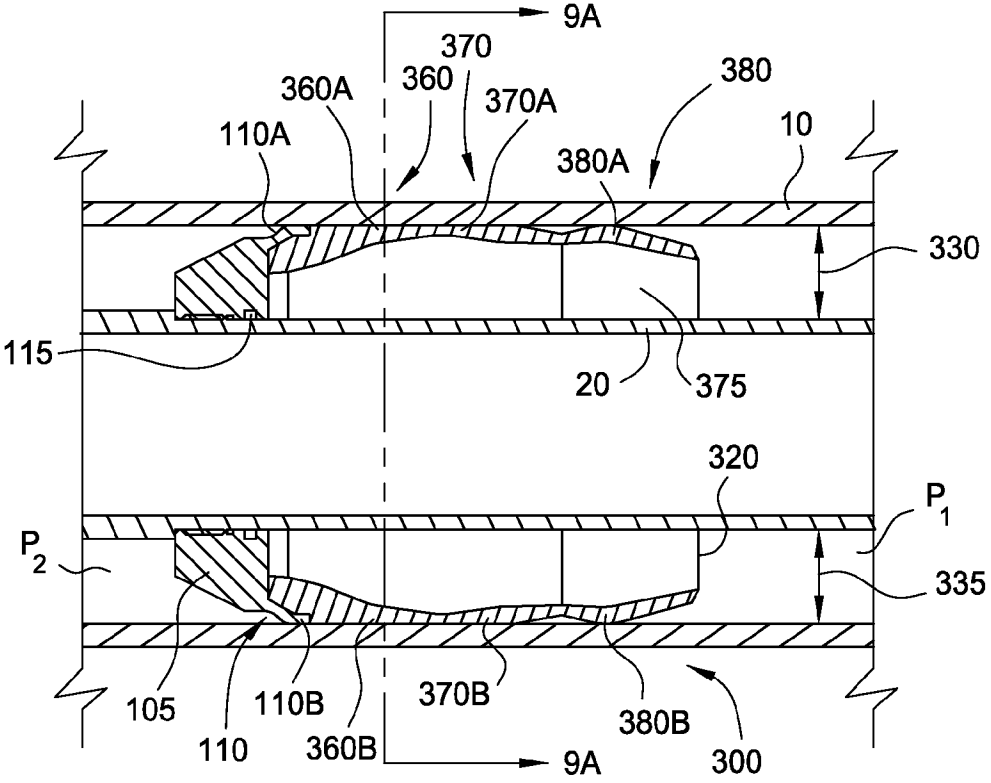

FIGS. 9 and 9A illustrate a view of the packer cup 300 in an expanded position. The packer cup 300 has been expanded by the pressure P1 in the annulus 375. In comparing FIG. 9 (expanded position) and FIG. 8 (intermediate expanded position), it can be seen that the upper portions 360A, 370A, 380A and the lower portions 360B, 370B, 380B of the seal segments have more surface area in contact with the casing 10. It can also be seen that the gap 195 has been closed, and the upper lip 110A and the lower lip 1108 are in contact with casing 10. In one embodiment, the lip 110 may act as a barrier to the flow of the material of the seal segments 360, 370, 380. In this manner, the lip 110 in the packer cup 300 may act as an anti-extrusion device or an extrusion barrier. In another embodiment, the lip 110 may also act as an anchor portion that secures the packer cup 300 in the casing 10.

FIG. 9A is a sectional view along line 9A-9A in FIG. 9. As shown, the thickness of the upper portion 360A of seal segment 360 is substantially equal to the thickness of the lower portion 360B of seal segment 360 because the portions 360A, 360B were radially expanded the same amount due to the packer cup 300 being centered in the casing 10. In this manner, the packer cup 300 is capable of sealing an annulus between the casing 10 and the string 20 when the packer cup 300 is centered in the casing 10.

Figure 10:
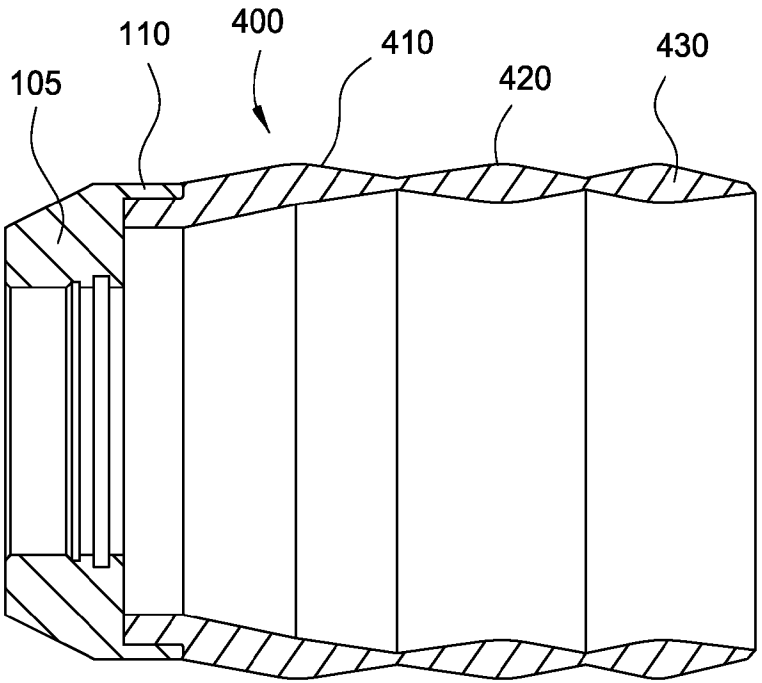
FIG. 10 illustrates a view of a packer cup.

FIG. 10 illustrates a view of a packer cup 400. For convenience, the components in the packer cup 400 that are similar to the components in the packer cup 100 will be labeled with the same number indicator. The packer cup 400 includes seal segments 410, 420, 430 and the base 105. The seal segments 410, 420, 430 are interconnected together. The seal segments 410, 420, 430 are designed to engage and create a seal with the casing (not shown) upon activation of the packer cup 400. As shown, the seal segments 420, 430 have the same thickness, and the seal segment 410 has a different thickness. Additionally, the seal segments 420, 430 have the same outer diameter, and seal segment 410 has a smaller outer diameter. Each characteristic (e.g., diameter, length, thickness, number of seal segments) of the seal segment 410, 420, 430 may be selected based upon the application in the wellbore.

Figure 11:
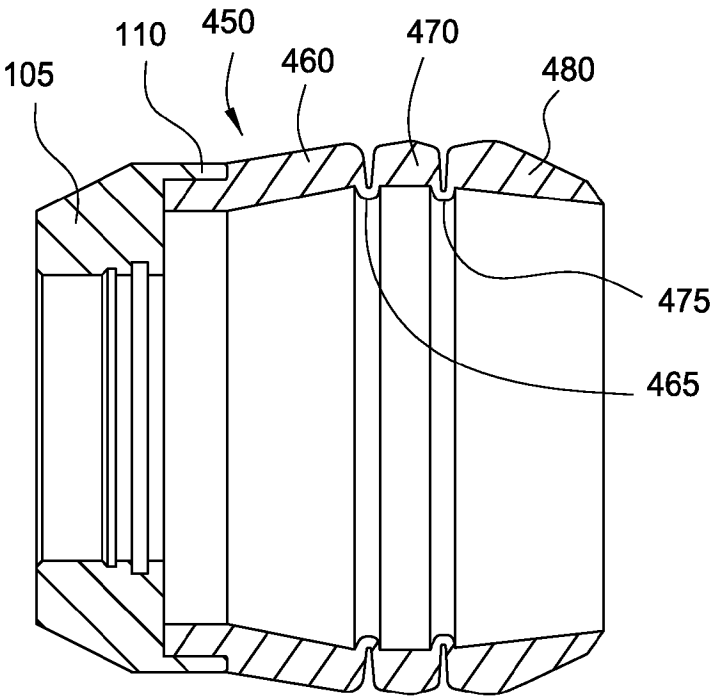
FIG. 11 illustrates a view of a packer cup.

FIG. 11 illustrates a view of a packer cup 450. For convenience, the components in the packer cup 450 that are similar to the components in the packer cup 100 will be labeled with the same number indicator. The packer cup 450 includes seal segments 460, 470, 480 and the base 105. The seal segments 460, 470, 480 are interconnected together. As shown, a first protrusion 465 is formed between seal segments 460, 470, and a second protrusion 475 is formed between seal segments 470, 480. The protrusions 465, 470 are formed when the packer cup 450 is being pulled up in the casing, or in the direction of the seal segments 460, 470, 480. The protrusions 465, 470 are formed as the shoulders of the seal segments 460, 470, 480 move toward each other due to the movement within the casing, and the seal segments 460, 470, 480 may contact each other. The protrusions 465, 470 provide additional stability to the seal segments 460, 470, 480 as the packer cup 450 is moved relative to the casing. The seal segments 460, 470, 480 are designed to engage and create a seal with the casing (not shown) upon activation of the packer cup 450. As shown, the seal segments 420, 430 have the same thickness, and the seal segment 410 has a different thickness. Each characteristic (e.g., diameter, length, thickness, number of seal segments) of the seal segment 460, 470, 480 may be selected based upon the application in the wellbore.

Figure 12:
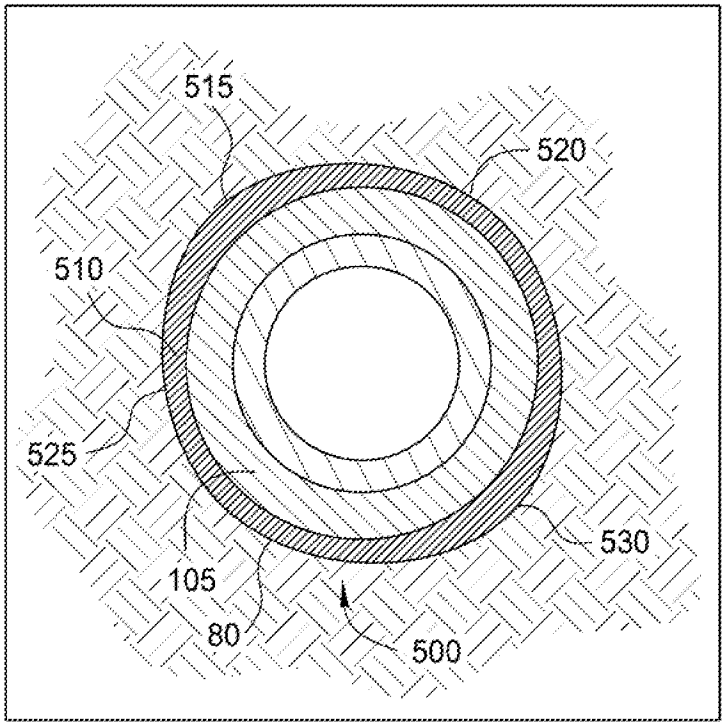
FIG. 12 illustrates a view of a packer cup in an eccentric wellbore.

FIG. 12 illustrates a view of a packer cup 500 in an eccentric wellbore 80. The packer cup 500 includes a seal segment 510 attached to the base 105. Although the packer cup 500 in FIG. 12 shows one seal segment 510, the packer cup 500 includes at least two seal segments. Similar to the seal segments described herein, the seal segment 510 is configured to move from a first shape to a second expanded shape to create a seal with the eccentric wellbore 80. The seal segment 510 in FIG. 12 is shown in the second expanded shape. The portions of the seal segment 510 expand in different amounts along an inner circumference of the eccentric wellbore 80. For instance, a first portion 515 of the seal segment 510 expanded a larger amount than a second portion 520, and a third portion 530 expanded further than a fourth portion 525, in order to engage the eccentric wellbore 80. In this manner, the seal segment 510 of the packer cup 500 is configured to conform to the inner circumference of the eccentric wellbore 80 in the second expanded shape.

Figure 13:
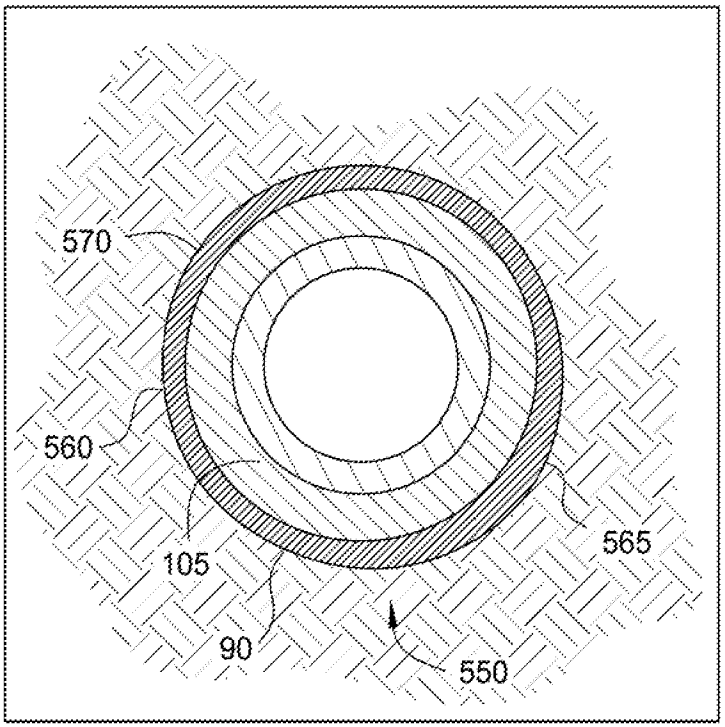
FIG. 13 illustrates a view of a packer cup in an eccentric wellbore.

FIG. 13 illustrates a view of a packer cup 550 in an eccentric wellbore 90. The packer cup 550 includes a seal segment 560 attached to the base 105. The packer cup 550 includes at least two seal segments. Similar to the seal segments described herein, the seal segment 560 is configured to move from a first shape to a second expanded shape to create a seal with the eccentric wellbore 90. The seal segment 560 in FIG. 13 is shown in the second expanded shape. In order to engage the eccentric wellbore 90, a first portion 565 of the seal segment 560 has expanded further than a second portion 570. In this manner, the seal segment 560 of the packer cup 550 is configured to conform to the inner circumference of the eccentric wellbore 90 in the second expanded shape.

While the foregoing is directed to embodiments of the present invention, other and further embodiments of the invention may be devised without departing from the basic scope thereof, and the scope thereof is determined by the claims that follow.

The invention claimed is:

1. A packer cup for use in a wellbore, the packer cup comprising:

a workstring;

a base fixed to the workstring;

a first seal segment attached to the base such that the workstring extends through the first seal segment; and a second seal segment that is spaced apart from the base and attached to the first seal segment, wherein each seal segment is configured to move from a retracted shape to an expanded shape upon activation of the respective seal segment, wherein an end of the first seal segment is connected to an end of the second seal segment such that a connection portion formed between the first and second seal segments has an outer diameter less than an outer diameter of the first and second seal segments when in the retracted shape, wherein the connection portion has an inner diameter less than an inner diameter of the first and second seal segments when in the retracted shape.

2. The packer cup of claim 1, wherein an outer diameter of the second seal segment is different than an outer diameter of the first seal segment.

3. The packer cup of claim 1, wherein an inner diameter of the second seal segment is different than an inner diameter of the first seal segment.

4. The packer cup of claim 1, wherein another end of the first seal segment is disposed under a lip of the base.

5. The packer cup of claim 4, wherein the lip is configured to expand radially outward into contact with the wellbore as the first seal segment moves from the retracted shape to the expanded shape.

6. The packer cup of claim 1, wherein a longitudinal axis of the packer cup is offset relative to a longitudinal axis of the wellbore.

7. The packer cup of claim 1, wherein the wellbore has an eccentric shape, and the seal segments are configured to conform to the eccentric shape of the wellbore.

8. The packer cup of claim 1, further comprising a third seal segment that is attached to another end of the second seal segment.

9. The packer cup of claim 8, wherein an outer diameter of the third seal segment is larger than an outer diameter of the second seal segment.

10. The packer cup of claim 1, wherein a thickness of the second seal segment is greater than a thickness of the first seal segment.

11. The packer cup of claim 1, wherein the first seal segment is made from a different material than the second seal segment.

12. The packer cup of claim 1, further comprising a third seal segment that is spaced apart from the base and attached to another end of the second seal segment, wherein each seal segment has a different outer diameter.

13. The packer cup of claim 12, wherein a thickness of the second seal segment is greater than a thickness of the first seal segment.

14. A method for creating a seal within a wellbore, the method comprising:

positioning a packer cup in the wellbore, the packer cup having a workstring, a base fixed to the workstring, a first seal segment attached to the base such that the workstring extends through the first seal segment, and a second seal segment spaced apart from the base and attached to the first seal segment, wherein an end of the first seal segment is connected to an end of the second seal segment such that a connection portion formed between the first and second seal segments has an outer diameter less than an outer diameter of the first and second seal segments when in a retracted shape, and wherein the connection portion has an inner diameter less than an inner diameter of the first and second seal segments when in the retracted shape;

activating the seal segments, which causes each seal segment to move from the retracted shape to an expanded shape; and creating the seal as the seal segments engage the wellbore in the expanded shape.

15. The method of claim 14, wherein pressure in the wellbore activates the seal segments of the packer cup.

16. The method of claim 14, wherein one end of the first seal segment is disposed under a lip of the base.

17. The method of claim 16, further including expanding an end of the lip radially outward into contact with the wellbore as the first seal segment moves from the retracted shape to the expanded shape.

18. The method of claim 14, wherein an outer diameter of the second seal segment is different than an outer diameter of the first seal segment.

19. The method of claim 14, wherein a longitudinal axis of the packer cup is offset relative to a longitudinal axis of the wellbore.

20. The method of claim 14, wherein the wellbore has an eccentric shape, and the seal segments are configured to conform to the eccentric shape of the wellbore.

* * * * *